US008773321B2

(12) United States Patent
Konishi

(10) Patent No.: US 8,773,321 B2
(45) Date of Patent: Jul. 8, 2014

(54) ANTENNA UNIT AND ELECTRONIC APPARATUS

(75) Inventor: Michihiro Konishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 126 days.

(21) Appl. No.: 13/137,986

(22) Filed: Sep. 22, 2011

(65) Prior Publication Data

US 2012/0013518 A1 Jan. 19, 2012

Related U.S. Application Data

(63) Continuation of application No. PCT/JP2009/056250, filed on Mar. 27, 2009.

(51) Int. Cl.
*H01Q 1/22* (2006.01)
*H01Q 13/18* (2006.01)

(52) U.S. Cl.
CPC ..... *H01Q 1/2266* (2013.01); *H01Q 13/18* (2013.01)
USPC ..... 343/789; 343/702

(58) Field of Classification Search
CPC .... H01Q 1/2266; H01Q 1/2258; H01Q 13/18
USPC ..... 343/789, 702
See application file for complete search history.

(56) References Cited

U.S. PATENT DOCUMENTS

| | | | | |
|---|---|---|---|---|
| 4,132,995 | A * | 1/1979 | Monser | 343/767 |
| 5,914,693 | A | 6/1999 | Takei et al. | |
| 6,243,040 | B1 * | 6/2001 | Corey et al. | 343/700 MS |
| 6,307,520 | B1 | 10/2001 | Liu | |
| 2002/0022459 | A1 | 2/2002 | Kobayashi | |
| 2004/0061509 | A1 | 4/2004 | Tsuchihashi et al. | |
| 2005/0099344 | A1 | 5/2005 | Okubo et al. | |

FOREIGN PATENT DOCUMENTS

| | | |
|---|---|---|
| JP | 09-074312 | 3/1997 |
| JP | 2002-064601 | 2/2002 |
| JP | 2004-061309 | 2/2004 |
| JP | 2004-180329 | 6/2004 |
| JP | 2005-073024 | 3/2005 |
| JP | 2005-142785 | 6/2005 |

OTHER PUBLICATIONS

International Search Report mailed on Jun. 30, 2009 in corresponding PCT Application No. PCT/JP2009/056250.

* cited by examiner

*Primary Examiner* — Robert Karacsony
*Assistant Examiner* — Amal Patel
(74) *Attorney, Agent, or Firm* — Staas & Halsey LLP

(57) ABSTRACT

An antenna unit includes a housing, a substrate, and an antenna. The housing includes a bottom wall, first and second side walls extending upward from the corresponding side edges of the bottom wall, a rear wall extending upward from the rear edge of the bottom wall, and an upper wall extending from the upper edge of the first side wall toward the second side wall leaving a gap between an edge of the upper wall and the second side wall. The substrate is fixed to the upper wall, and a part of the substrate projects from the edge of the upper wall to a position that is closer to the second side wall than is the edge of the upper wall. The antenna is fixed to the part of the substrate projecting from the edge of the upper wall such that a radio-wave emitting aperture of the antenna faces forward.

9 Claims, 7 Drawing Sheets

10
30
20
22
24
21
23
100
114b
114a
123
130
114c
110
114
126
125
A
112
113
110a
111
121
111a
115
120
131
A
124
122

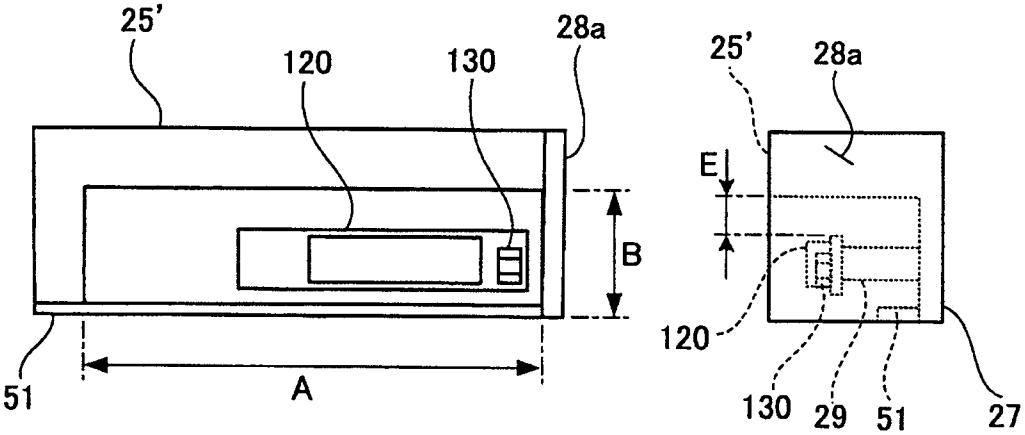
FIG.6C
FIG.6B
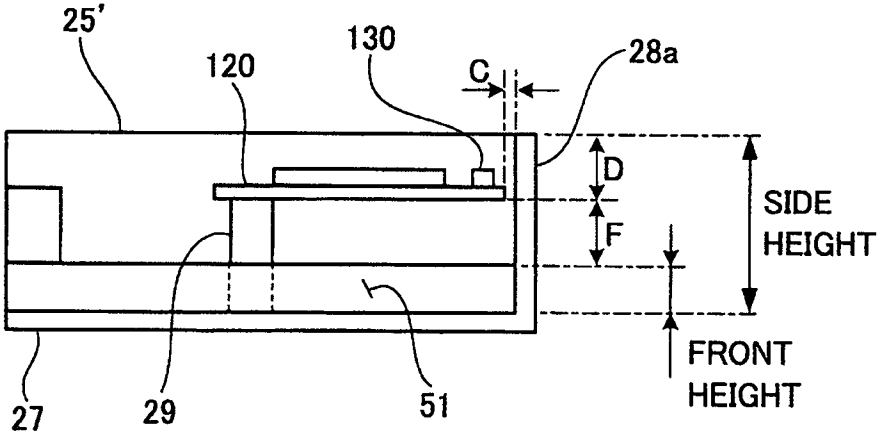
FIG.6A

ANTENNA UNIT AND ELECTRONIC APPARATUS

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2009/056250, filed on Mar. 27, 2009, the entire contents of which are incorporated herein by reference.

FIELD

The embodiments discussed herein are related to an antenna unit and an electronic apparatus including the antenna unit.

BACKGROUND

Electronic apparatuses having a radio communication function such as a notebook personal computer (PC) and a personal digital assistant (PDA) are widely used. Such an electronic apparatus having a radio communication function includes a small antenna for radio communications with other apparatuses (see, for example, Japanese Laid-Open Patent Publications No. 09-074312, No. 2004-061309, and No. 2004-180329).

Generally, if a conductor such as a metal is present near an antenna, radio communications via the antenna are disturbed by the conductor. Therefore, in an electronic apparatus, an antenna is normally disposed sufficiently away from conductive components of the electronic apparatus to achieve high antenna gain.

SUMMARY

According to an aspect of the invention, there is provided an antenna unit including a housing composed of a conductive material, a substrate, and an antenna. The housing includes a bottom wall, first and second side walls that extend upward from the corresponding side edges of the bottom wall, a rear wall that extends upward from the rear edge of the bottom wall along the rear edges of the first and second side walls, and an upper wall that extends from the upper edge of the first side wall toward the second side wall leaving a gap between an edge of the upper wall and the second side wall. The substrate is fixed to the upper wall, and a part of the substrate projects from the edge of the upper wall to a position that is closer to the second side wall than is the edge of the upper wall. The antenna is fixed to the part of the substrate projecting from the edge of the upper wall such that a radio-wave emitting aperture of the antenna faces forward.

The object and advantages of the invention will be realized and attained by means of the elements and combinations particularly pointed out in the claims.

It is to be understood that both the foregoing general description and the followed detailed description are exemplary and explanatory and are not restrictive of the invention as claimed.

BRIEF DESCRIPTION OF DRAWINGS

FIGS. 6A through 6C are drawings illustrating a common configuration of samples of a comparative example.

DESCRIPTION OF EMBODIMENTS

There is an increasing demand for a smaller electronic apparatus such as a notebook PC. To reduce the size of an electronic apparatus, it is necessary to package components of the electronic apparatus more densely. Meanwhile, as described above, it is necessary to dispose an antenna sufficiently away from conductive components of an electronic apparatus to achieve high antenna gain. However, this increases a space needed to install an antenna (i.e., a space occupied by an antenna) in an electronic apparatus and makes it difficult to package components of the electronic apparatus densely.

An aspect of this disclosure provides an antenna unit and an electronic apparatus including the antenna unit that makes it possible to reduce the space needed to install an antenna in the electronic apparatus.

Preferred embodiments of the present invention will be described with reference to the accompanying drawings.

Figure 1:
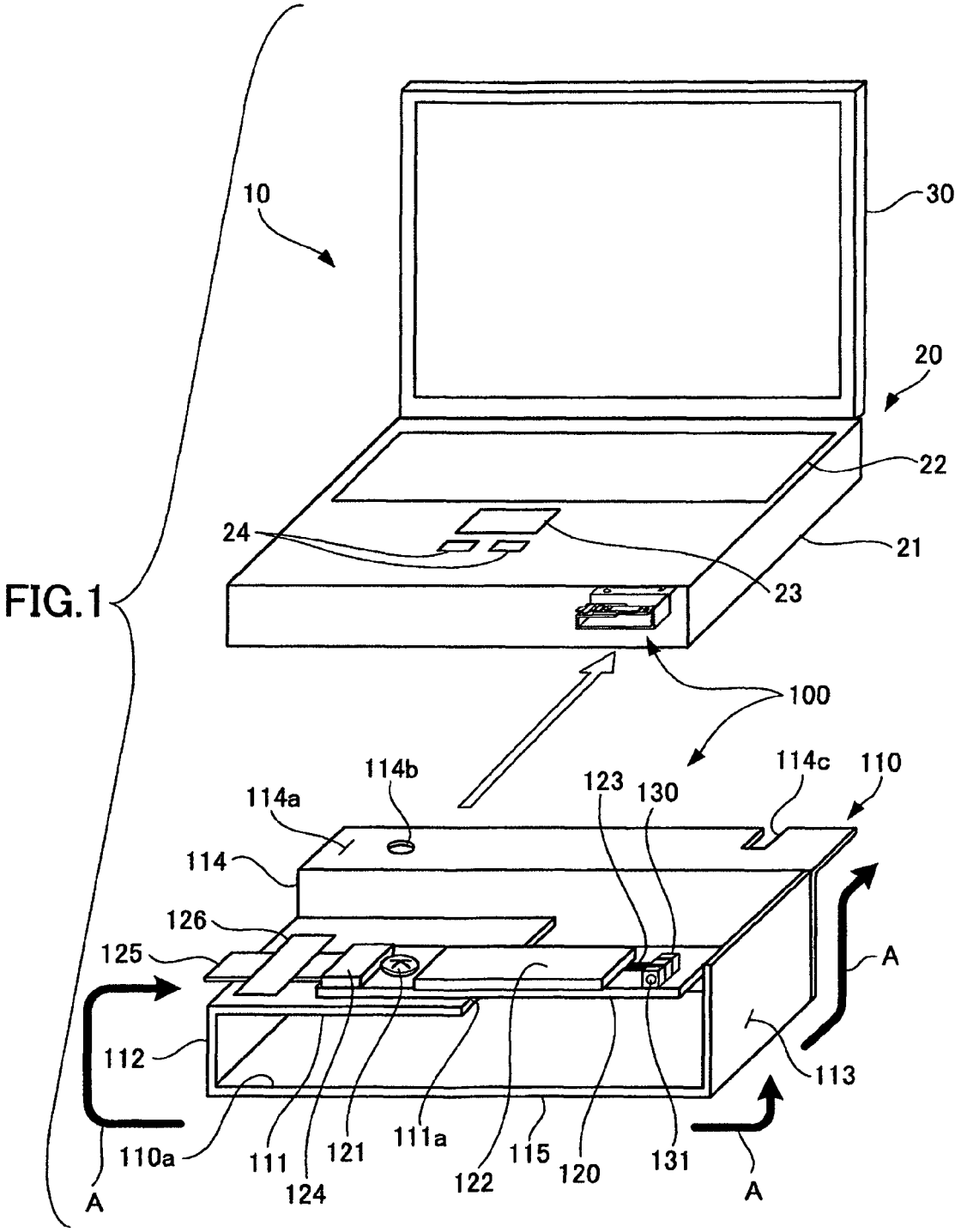
FIG. 1 is a drawing illustrating a notebook personal computer provided as an example of an electronic apparatus according to an embodiment.

FIG. 1 is a drawing illustrating a notebook personal computer (PC) 10 provided as an example of an electronic apparatus according to an embodiment.

As illustrated in FIG. 1, the notebook PC 10 includes a main unit 20 and a display unit 30 that are connected with each other such that the display unit 30 can be opened and closed with respect to the main unit 20.

The main unit 20 includes a main housing 21 that houses components such as a hard disk drive and circuit boards. The main unit 20 also includes a keyboard 22, a trackpad 23, and buttons 24 provided on the upper surface of the main housing 21.

Further, an antenna unit 100 is installed in the main unit 20. The antenna unit 100 includes a radio communication antenna used to send and receive radio signals. In this embodiment, the antenna unit 100 is disposed at the front right corner of the main unit 20.

An enlarged view of the antenna unit 100 is provided in the lower part of FIG. 1.

The antenna unit 100 includes a housing 110, a substrate 120, and a chip antenna 130.

Figure 2B:
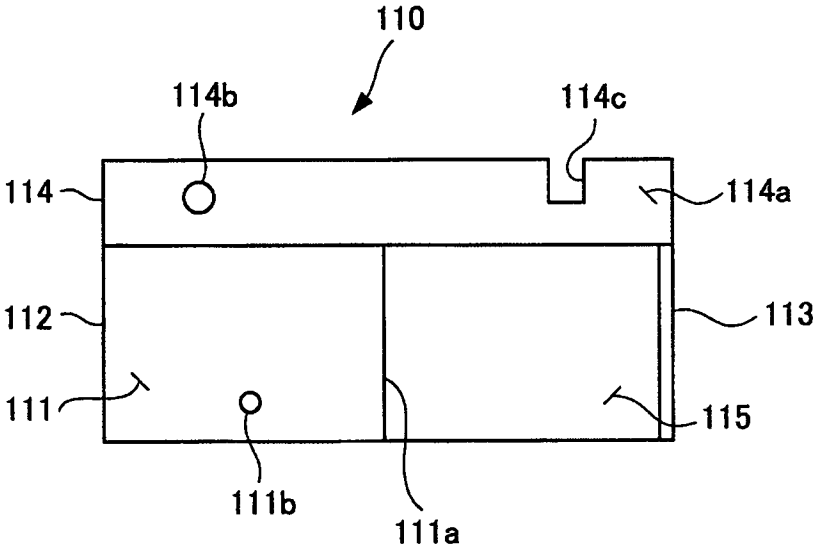
FIGS. 2A through 2C are drawings illustrating three sides of a housing of an antenna unit.
Figure 2A:
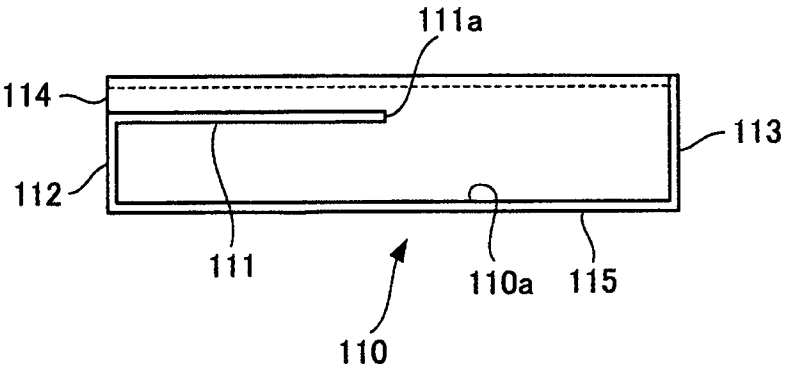
Figure 2C:
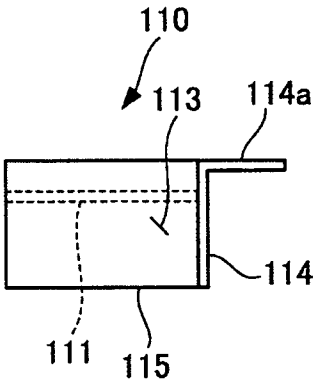

FIGS. 2A through 2C are drawings illustrating three sides of the housing 110.

FIG. 2A is a front view, FIG. 2B is a top view, and FIG. 2C is a right-side view of the housing 110.

The housing 110 may be made of a metal plate and includes an upper wall 111, a left-side wall 112, a right-side wall 113, a rear wall 114, and a bottom wall 115.

The left-side wall 112 and the right-side wall 113 extend upward from the left and right edges of the bottom wall 115. The rear wall 114 extends upward from the rear edge of the bottom wall 115 along the rear edges of the left-side wall 112 and the right-side wall 113. The upper wall 111 extends from the upper edge of the left-side wall 112 toward the right-side wall 113 leaving a gap between the right edge of the upper wall 111 and the right-side wall 113.

With the walls configured as described above, a first opening 110*a* is formed on the front side of the housing 110. Also, the gap between the right edge of the upper wall 111 and the right-side wall 113 forms a second opening 111*a* connecting with the first opening 110*a*.

The rear wall 114 may have a height that is substantially the same as the height of a slot of the main unit 20 where the antenna unit 100 is installed. Also, the right-side wall 113 may have a height that is substantially the same as the height of the rear wall 114. A part of the rear wall 114 further extends rearward from the upper edge of a part of the rear wall 114 extending upward. In other words, the rear wall 114 is bent rearward at a position corresponding to the height of the rear wall 114. The part of the rear wall 114 extending rearward is called a flange 114*a* that is used to screw the antenna unit 100 to the main unit 20. A through hole 114*b* and a notch 114*c* for screwing the antenna unit 100 (or the flange 114*a*) to the main unit 20 via screws 26 (FIG. 3) are formed in the flange 114*a*.

The flange 114*a* of the housing 110 makes it possible to reliably attach the antenna unit 100 to the main unit 20 or an electronic apparatus. Although the flange 114*a* is described as a part of the rear wall 114 in this embodiment, the flange 114*a* and the rear wall 114 may be separate parts. In this case, the flange 114*a* extends rearward from the upper edge of the rear wall 114.

The housing 110 may be formed by folding a single metal plate as indicated by arrows A in FIG. 1 and then welding the rear edges of the left- and right-side walls 112 and 113 and the rear edge of the upper wall 111 to the rear wall 114.

Forming the housing 110 by folding a single metal plate (or a conductive plate) makes it possible to simplify the production process and to reduce the production cost of the antenna unit 110.

Accordingly, the housing 110 is preferably formed by folding a single conductive plate.

The upper wall 111 of the housing 110 also functions as a flange to which the substrate 120 is screwed. Therefore, a through hole 111*b* for screwing the substrate 120 is formed in the upper wall 111.

Next, the substrate 120 is described below with reference FIG. 1.

The substrate 120 is a strip-shaped plate and is fixed to the upper wall 111 with a screw 121. A part of the substrate 120 projects from the right edge (that is closer to the right-side wall 113) of the upper wall 111 over the second opening 111*a* to a position near the right-side wall 113. The chip antenna 130 is fixed to the part of the substrate 120 projecting from the upper wall 111 over the second opening 111*a*.

In this embodiment, it is assumed that the chip antenna 130 is a Bluetooth (registered trademark) antenna for radio communications. Also, a communication module (Bluetooth (BT) module) 122 for controlling radio communications via the chip antenna 130 is mounted on the substrate 120. The chip antenna 130 and the BT module 122 are electrically connected with each other via a feed pattern 123 formed on the substrate 120. Radio frequency (RF) signals transmitted and received via the chip antenna 130 are received from and sent to the BT module 122 via the feed pattern 123.

A flexible flat cable (FFC) connector 124 is provided as an external interface at the left edge of the substrate 120. An FFC 125 for connecting the substrate 120 and an external apparatus is connected to the FFC connector 124. The FFC 125 is also fixed to the upper wall 111 of the housing 110 with a tape 126.

Next, the chip antenna 130 is described in more detail.

The chip antenna 130 is a Bluetooth (registered trademark) antenna for radio communications and is fixed to a part of the substrate 120 projecting from the edge of the upper wall 111 over the second opening 111*a*.

As illustrated in FIG. 1, the chip antenna 130 may have a shape like a cuboid. A radio-wave emitting aperture 131 is provided in one of two side surfaces of the chip antenna 130 which cross the long axis of the chip antenna 130. The chip antenna 130 is fixed to the substrate 120 such that the radio-wave emitting aperture 131 is oriented toward the first opening 110*a* of the housing 110, i.e., such that the radio-wave emitting aperture 131 faces forward.

The housing 110 of the antenna unit 100 functions like a cavity resonator and improves the antenna gain of the chip antenna 130 (this is described in more detail later). Therefore, even if the antenna unit 100 is installed near a metal component, the reduction in the antenna gain caused by the metal component is compensated for by the increase in the antenna gain achieved by the housing 110. Thus, the above configuration makes it possible to achieve high antenna gain. In other words, the antenna unit 100 of this embodiment eliminates the need to care about the distance between the chip antenna 130 and metal components around the antenna unit 100 and makes it possible to reduce the space needed to install the chip antenna 130 while achieving high antenna gain.

Figure 3:
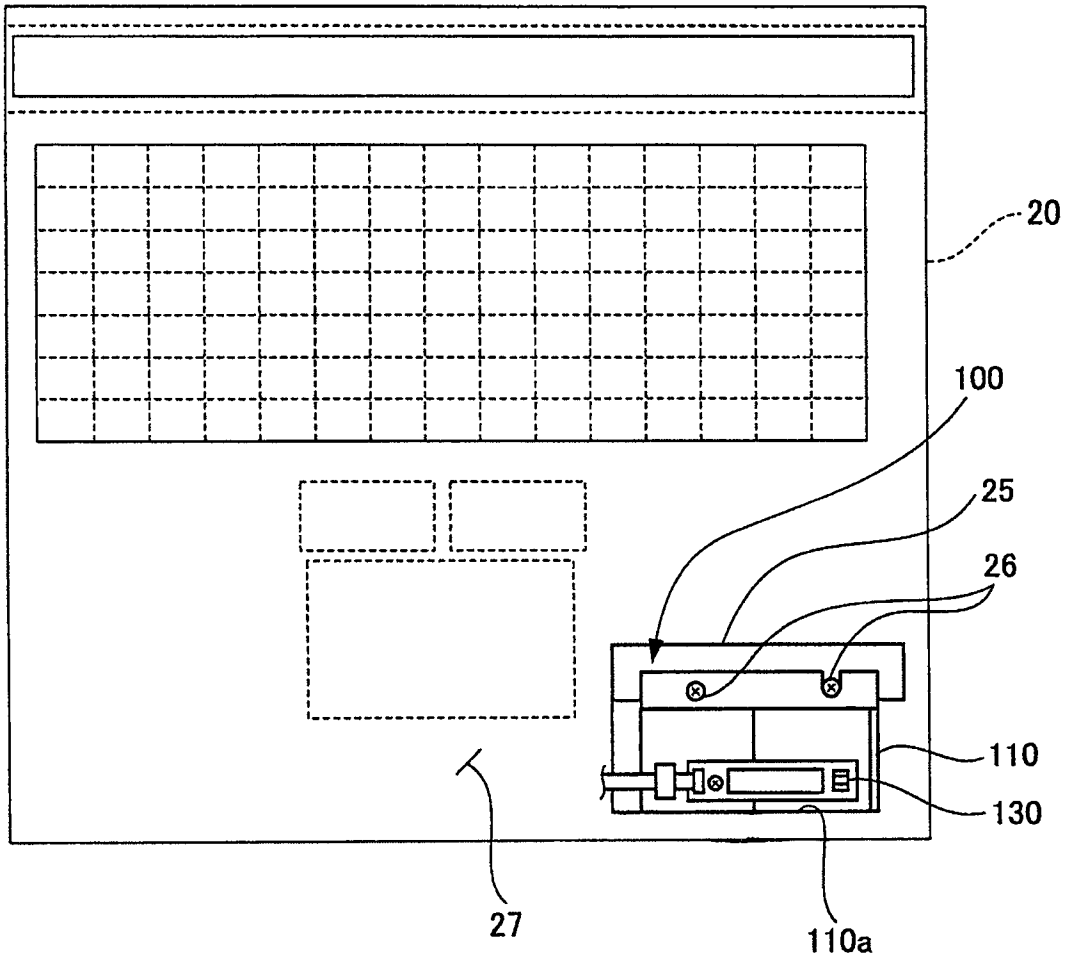
FIG. 3 is a drawing illustrating an antenna unit installed in a main unit.

FIG. 3 is a drawing illustrating the antenna unit 100 installed in the main unit 20.

In this example, the antenna unit 100 is disposed at the front right corner of the main unit 20. More specifically, the antenna unit 100 is mounted on the front right corner of a bottom plate 27 of the main housing 21 of the main unit 20. In the main unit 20, it is preferable that only non-conductive components are disposed in the radio-wave emitting direction from the front side the antenna unit 100 (or in front of the radio-wave emitting aperture 131 of the chip antenna 130) and above the antenna unit 100.

Below, the effect of the antenna unit 100 of this embodiment in reducing the space for installing the chip antenna 130 is described in comparison with a comparative example.

Figure 4:
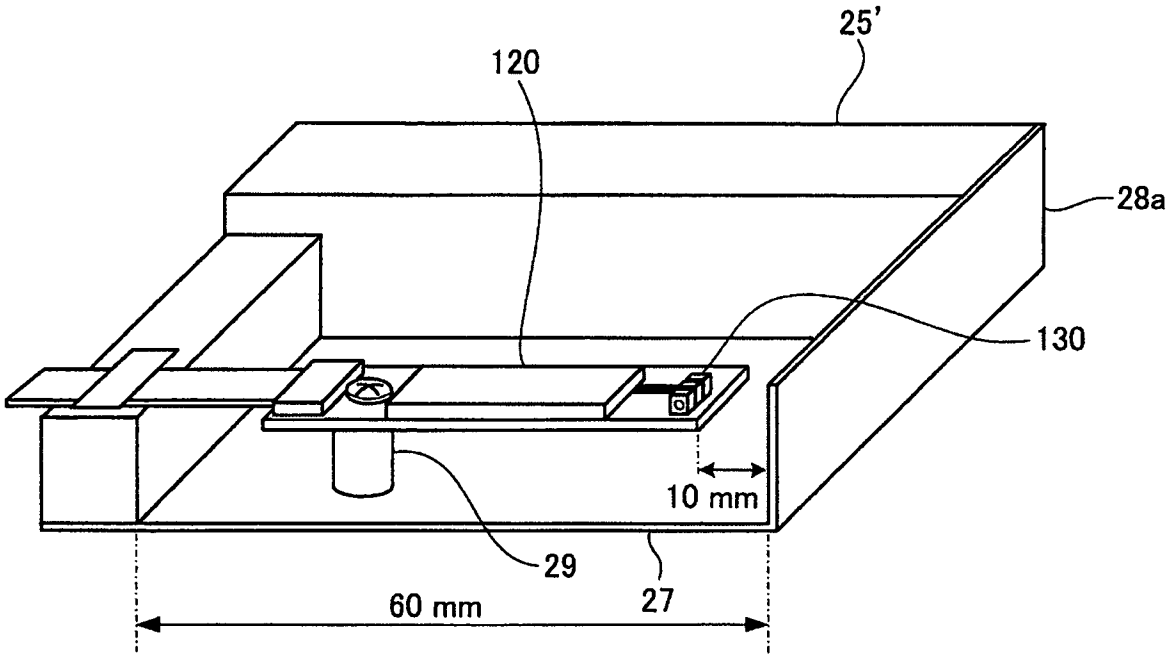
FIG. 4 is a drawing illustrating a comparative example.

FIG. 4 is a drawing illustrating a comparative example.

The same reference numbers as those used in FIG. 1 are used for the corresponding components in FIG. 4 and overlapping descriptions of those components are omitted here.

In the comparative example, as illustrated in FIG. 4, the substrate 120, on which the chip antenna 130 is mounted, is screwed to a boss 29 formed on the bottom plate 27 of the main housing 21 of the main unit 20

Here, in the example illustrated in FIG. 3, the antenna unit 100 is surrounded by a mounting block 25 made of a conductive material. In FIG. 4, similarly to FIG. 3, the substrate 120 is surrounded by a conductive block 25' with a shape similar to the mounting block 25. With the configuration of the comparative example illustrated in FIG. 4, to achieve high antenna gain, the chip antenna 130 needs to be separated by about 10 mm from a right-side metal panel 28*a* of the main housing 21 which is closest to the chip antenna 130. In this case, the distance between the right-side panel of the main housing 21 and the conductive block 25' facing the right-side panel across the substrate 120, i.e., the width of a space necessary to install the chip antenna 130 without reducing the antenna gain, becomes about 60 mm.

Meanwhile, with the antenna unit 100 of this embodiment, the space necessary to install the chip antenna 130 can be reduced while achieving high antenna gain.

Figure 5:
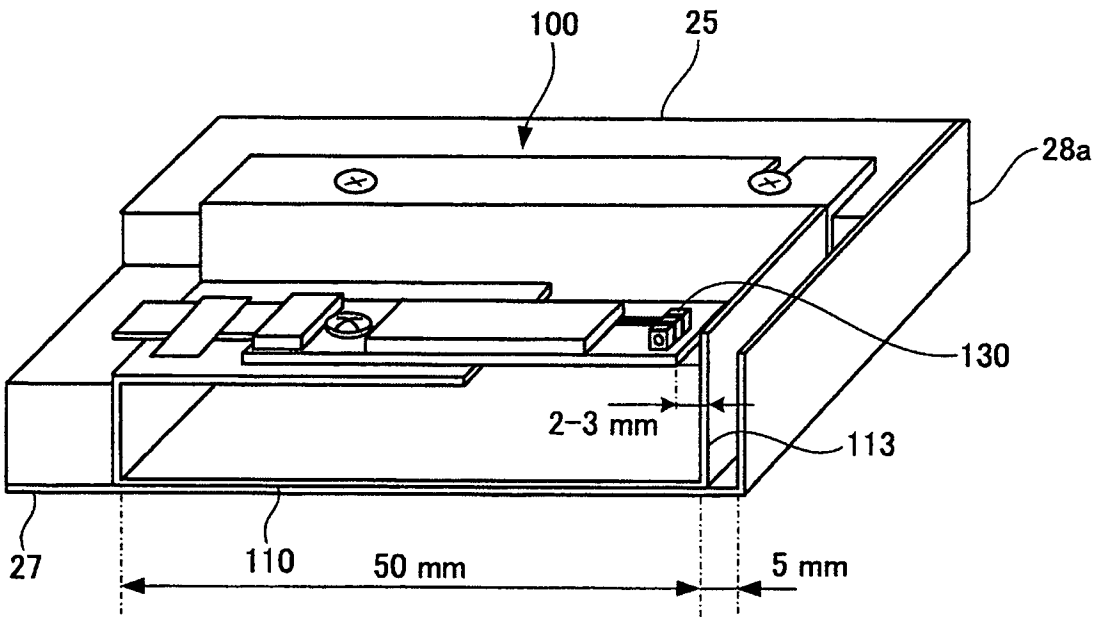
FIG. 5 is a drawing illustrating an example where a chip antenna is installed using an antenna unit of an embodiment.

FIG. 5 is a drawing illustrating an example where the chip antenna 130 is installed using the antenna unit 100 of this embodiment.

In FIG. 5, the antenna unit 100 is screwed to the mounting block 25. With the antenna unit 100 of this embodiment, as illustrated in FIG. 5, the chip antenna 110 can be placed as close as about 2 to 3 mm to the right-side wall 113 of the housing 110, which is a metal surface that is closest to the chip antenna 130, while achieving high antenna gain.

Also with the antenna unit 100 of this embodiment, the space necessary to install the chip antenna 130 while achieving high antenna gain is substantially the same as the space occupied by the housing 110. Since the chip antenna 130 can be placed close to the right-side wall 113 of the housing 110, the housing 110 may be configured to have a width of, for example, about 50 mm. Also, as described later in detail, the antenna unit 100 can be placed as close as about 5 mm to the right-side metal panel 28*a* of the main housing 21 of the main unit 20 while achieving high antenna gain. Accordingly, compared with the configuration of the comparative example, the antenna unit 100 of this embodiment makes it possible to reduce the width of the space necessary to install the chip antenna 130 by about 10 mm.

Thus, the antenna unit 100 of this embodiment makes it possible to reduce the space necessary to install the chip antenna 130 while achieving high antenna gain.

Next, the results of experiments performed using samples of this embodiment and samples of the comparative example are described.

First, the antenna gain of the chip antenna 130 was measured for each of 18 samples of the comparative example described with reference to FIG. 4. The 18 samples have a common configuration but have different dimensions.

tive block 25'. The distance A of each of the 18 samples was set at 50 mm or 70 mm. In FIG. 6A, "C" indicates the distance between the metal panel 28*a* and the substrate 120. The distance C of each of the 18 samples was set at 1 mm, 3 mm, 5 mm, or 7 mm. In FIG. 6A, "D" indicates the difference between the height of the metal panel 28*a* and the height of the substrate 120. The distance D of each of the 18 samples was set at 0 mm, 3 mm, or 5 mm. In FIG. 6C, "E" indicates the distance between the conductive block 25' and the substrate 120 in the depth direction. The distance E of each of the 18 samples was set at 5 mm or 7 mm. In FIG. 6A, "F" indicates the difference between the height of the front panel 51 and the height of the substrate 120. The distance F of each of the 18 samples was set at 10 mm, 13 mm, 15 mm, or 20 mm. The height (front height) of the front panel 51 of each of the 18 samples was set at 0 mm, 5 mm, 7 mm, or 10 mm. The height (side height) of the right-side metal panel 28*a* of each of the 18 samples was set at 0 mm, 5 mm, 10 mm, or 20 mm.

In FIG. 6B, "B" indicates the distance between the front surface (in the radio-wave emitting direction) of the front panel 51 and the conductive block 25' in the depth direction. The distance B was set at 15 mm for all of the 18 samples. Also, the height of the boss 29 (i.e., a module mounting height) was set at 20 mm for all of the 18 samples.

As indicated in table 1 below, the dimensions of the 18 samples are combinations of the above described values.

TABLE 1

| | Module Mounting Height = 20 mm | | | | | | | | X-Y plane average gain (dBi) | | | |
|---|---|---|---|---|---|---|---|---|---|---|---|---|
| | A (mm) | B (mm) | C (mm) | D (mm) | E (mm) | F (mm) | Front Height (mm) | Side Height (mm) | 2.4 (GHz) | 2.442 (GHz) | 2.484 (GHz) | Total Average |
| Test 1 | 50 | 15 | 7 | 0 | 5 | 10 | 10 | 10 | −11.0 | −10.6 | −11.1 | −10.9 |
| Test 2 | 50 | 15 | 7 | 0 | 5 | 15 | 5 | 5 | −10.3 | −9.7 | −10.1 | −10.0 |
| Test 3 | 50 | 15 | 7 | 0 | 7 | 15 | 5 | 5 | −9.1 | −8.7 | −9.0 | −8.9 |
| Test 4 | 50 | 15 | 7 | 3 | 7 | 15 | 5 | 5 | −9.7 | −9.5 | −10.1 | −9.8 |
| Test 5 | 50 | 15 | 1 | 0 | 7 | 15 | 5 | 20 | −9.3 | −8.6 | −8.8 | −8.9 |
| Test 6 | 50 | 15 | 1 | 0 | 7 | 15 | 5 | 0 | −5.3 | −6.0 | −7.1 | −6.1 |
| Test 7 | 50 | 15 | 1 | 5 | 7 | 20 | 0 | 20 | −8.4 | −8.0 | −8.2 | −8.2 |
| Test 8 | 50 | 15 | 1 | 5 | 7 | 20 | 0 | 20 | −5.0 | −6.0 | −6.6 | −5.8 |
| Test 9 | 50 | 15 | 1 | 3 | 7 | 15 | 5 | 20 | −6.0 | −7.0 | −8.1 | −6.9 |
| Test 10 | 50 | 15 | 3 | 3 | 7 | 15 | 5 | 20 | −6.3 | −6.9 | −7.9 | −7.0 |
| Test 11 | 50 | 15 | 5 | 3 | 7 | 15 | 5 | 20 | −6.8 | −7.0 | −7.9 | −7.2 |
| Test 12 | 50 | 15 | 7 | 3 | 7 | 15 | 5 | 20 | −7.2 | −7.3 | −8.0 | −7.5 |
| Test 13 | 70 | 15 | 1 | 3 | 7 | 15 | 5 | 20 | −7.6 | −8.7 | −9.8 | −8.6 |
| Test 14 | 70 | 15 | 7 | 3 | 7 | 15 | 5 | 20 | −9.7 | −9.8 | −10.6 | −10.0 |
| Test 15 | 50 | 15 | 1 | 3 | 7 | 13 | 7 | 20 | −6.7 | −7.8 | −8.9 | −7.7 |
| Test 16 | 50 | 15 | 1 | 3 | 7 | 10 | 10 | 20 | −7.9 | −9.0 | −10.1 | −8.9 |
| Test 17 | 50 | 15 | 1 | 3 | 7 | 15 | 5 | 20 | −10.0 | −9.4 | −9.7 | −9.7 |
| Test 18 | 50 | 15 | 1 | 3 | 7 | 15 | 5 | 20 | −7.7 | −7.8 | −8.0 | −7.8 |

FIGS. 6A through 6C are drawings illustrating a common configuration of the 18 samples of the comparative example that were used to measure antenna gain.

FIG. 6A is a front view, FIG. 6B is a top view, and FIG. 6C is a right-side view of the configuration of the comparative example.

The configuration illustrated by FIGS. 6A through 6C is substantially the same as the configuration illustrated by FIG. 4. In the configuration of FIGS. 6A through 6C, however, a metal front panel 51 is provided at a low position in the radio-wave emitting direction from the front side of the chip antenna 130 (or in front of the radio-wave emitting aperture 131).

In FIG. 6B, "A" indicates the distance between the right-side metal panel 28*a* of the main housing 21 and the conduc- For each of the 18 samples, the average gain (dBi) on a plane (X-Y plane) along the bottom plate 27 was measured at three communication frequencies of 2.4 GHz, 2.442 GHz, and 2.484 GHz. The measurement results at the three communication frequencies and the total average of the measurement results are provided in table 1 for each of the 18 samples.

As the results indicate, with the configuration of the comparative example, the gain was mostly less than −7 dBi.

The conductive block 25', the right-side metal panel 28*a*, and the front panel 51 adversely affect the antenna gain of the chip antenna 130, and are used as conditions for determining the minimum distance between the chip antenna 130 and conductive components of the main unit 20 which is necessary to maintain high antenna gain. For this reason, in the comparative example of FIGS. 6A through 6C, the conductive block 25', the right-side metal panel 28*a*, and the front panel 51 are disposed to form a box surrounding the chip antenna 130.

Next, the antenna gain of the chip antenna 130 was measured for each of 24 samples that use the antenna unit 100 of the above embodiment. The 24 samples have a common configuration as illustrated in FIG. 5 but have different dimensions.

Figure 7:
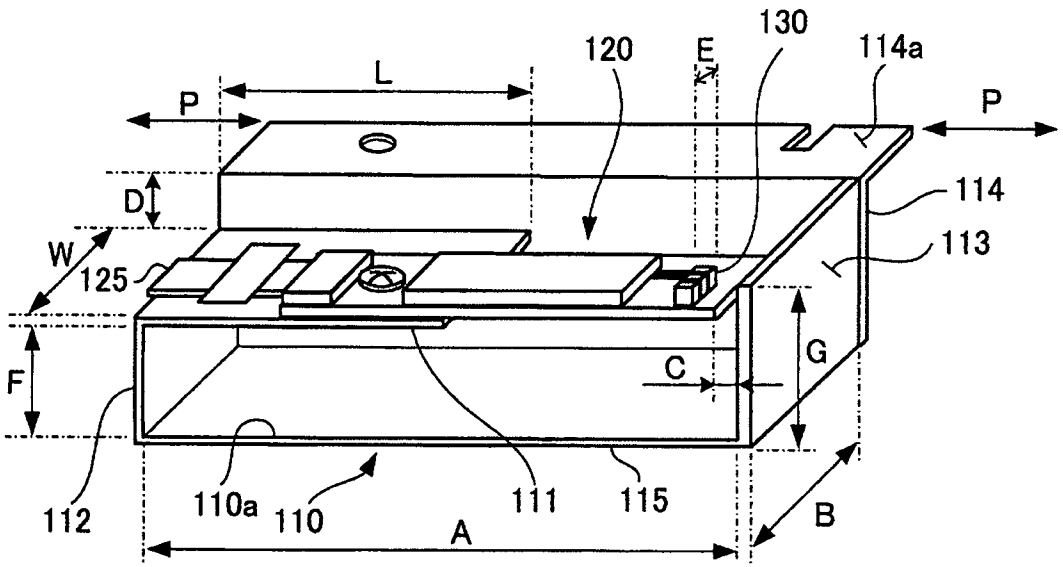
FIG. 7 is a drawing illustrating a common configuration of samples of an embodiment.

FIG. 7 is a drawing illustrating a common configuration of the 24 samples of the embodiment that were used to measure antenna gain.

The 24 samples differ from each other in their dimensions and in whether the FFC 125 is connected to the substrate 120 (or the FFC connector 124).

each of the 24 samples was set at 25 mm or 35 mm. "W" indicates the width of the upper wall 111 in the depth direction. The width W of each of the 24 samples was set at 10 mm, 15 mm, or 20 mm.

"A" indicates the distance between the left-side wall 112 and the right-side wall 113. The distance A was set at 55 mm for all of the 24 samples. "B" indicates the width of the left-side wall 112, the right-side wall 113, and the bottom wall 115 (which have the same width) in the depth direction. The width B was set at 20 mm for all of the 24 samples. "G" indicates the height of the right-side wall 113. The height G was set at 15 mm for all of the 24 samples.

As indicated in table 2 below, the dimensions of the 24 samples are combinations of the values described above. Also, the 24 samples differ in whether the FFC 125 is connected to the substrate 120.

TABLE 2

| | A = 50 mm, B = 20 mm, G = 15 mm | | | | | | | | X-Y plane average gain (dBi) | | | |
|---|---|---|---|---|---|---|---|---|---|---|---|---|
| | C (mm) | D (mm) | E (mm) | F (mm) | P (mm) | L (mm) | W (mm) | FFC | 2.4 (GHz) | 2.442 (GHz) | 2.484 (GHz) | Total Average |
| Test 1 | 3 | 5 | 12 | 10 | 5 | 35 | 20 | NO | −4.5 | −4.9 | −5.1 | −4.83 |
| Test 2 | 5 | 5 | 12 | 10 | 5 | 35 | 20 | NO | −5.7 | −6.2 | −6.5 | −6.12 |
| Test 3 | 3 | 5 | 12 | 10 | 20 | 35 | 20 | NO | −5.0 | −5.6 | −5.8 | −5.45 |
| Test 4 | 5 | 5 | 12 | 10 | 20 | 35 | 20 | NO | −4.8 | −5.4 | −5.7 | −5.28 |
| Test 5 | 3 | 5 | 12 | 10 | −20 | 35 | 20 | NO | −4.3 | −4.3 | −4.1 | −4.23 |
| Test 6 | 5 | 5 | 12 | 10 | −20 | 35 | 20 | NO | −5.1 | −5.2 | −5.1 | −5.13 |
| Test 7 | 3 | 5 | 12 | 10 | −5 | 35 | 20 | NO | −7.7 | −8.1 | −8.1 | −7.96 |
| Test 8 | 5 | 5 | 12 | 10 | −5 | 35 | 20 | NO | −6.2 | −7 | −7.3 | −6.81 |
| Test 9 | 3 | 5 | 12 | 10 | 5 | 35 | 20 | YES | −5.8 | −6.4 | −6.6 | −6.25 |
| Test 10 | 5 | 5 | 12 | 10 | 5 | 35 | 20 | YES | −4 | −4.7 | −5.1 | −4.58 |
| Test 11 | 3 | 5 | 12 | 10 | 5 | 35 | 15 | NO | −8.3 | −7.9 | −7.8 | −7.99 |
| Test 12 | 5 | 5 | 12 | 10 | 5 | 35 | 15 | NO | −8.8 | −8.1 | −7.4 | −8.06 |
| Test 13 | 3 | 5 | 12 | 10 | 5 | 25 | 15 | NO | −7 | −6.5 | −6.4 | −6.63 |
| Test 14 | 5 | 5 | 12 | 10 | 5 | 25 | 15 | NO | −6.8 | −6.2 | −5.6 | −6.17 |
| Test 15 | 3 | 3 | 12 | 12 | 5 | 35 | 20 | NO | −3.1 | −3.6 | −3.7 | −3.46 |
| Test 16 | 5 | 3 | 12 | 12 | 5 | 35 | 20 | NO | −3.4 | −4 | −4.2 | −3.85 |
| Test 17 | 3 | 3 | 12 | 12 | 5 | 35 | 20 | YES | −4.3 | −4.9 | −5.1 | −4.75 |
| Test 18 | 5 | 3 | 12 | 12 | 5 | 35 | 20 | YES | −2.8 | −3.3 | −3.7 | −3.25 |
| Test 19 | 3 | 3 | 12 | 12 | 5 | 35 | 15 | NO | −7.8 | −7.6 | −7.7 | −7.70 |
| Test 20 | 5 | 3 | 12 | 12 | 5 | 35 | 15 | NO | −7.9 | −7.5 | −7.2 | −7.52 |
| Test 21 | 3 | 3 | 12 | 12 | 5 | 25 | 15 | NO | −5.8 | −5.4 | −5.3 | −5.49 |
| Test 22 | 5 | 3 | 12 | 12 | 5 | 25 | 15 | NO | −5.9 | −5.4 | −5.1 | −5.45 |
| Test 23 | 3 | 5 | 7 | 10 | 5 | 25 | 10 | YES | −7.8 | −7.4 | −6.8 | −7.31 |
| Test 24 | 5 | 5 | 7 | 10 | 5 | 25 | 10 | YES | −7.9 | −7.5 | −6.9 | −7.41 |

In FIG. 7, "C" indicates the distance between the right-side wall 113 and the substrate 120. The distance C of each of the 24 samples was set at 3 mm or 5 mm. "D" indicates the difference between the height of the flange 114*a* and the height of the upper wall 111. The difference D of each of the 24 samples was set at 3 mm or 5 mm. "E" indicates the distance between the rear wall 114 and the substrate 120 in the depth direction. The distance E of each of the 24 samples was set at 7 mm or 12 mm. "F" indicates the distance between the bottom wall 115 and the upper wall 111 (i.e., the height of the first opening 110*a*). The distance F of each of the 24 samples was set at 10 mm or 12 mm. "P" indicates the distance between a left-side or right-side metal panel 28*a* of the main housing 21 and the antenna unit 100. The distance P of each of the 24 samples was set at 5 mm, 20 mm, −5 mm, or −20 mm. Here, the distance P between the right-side metal panel 28*a* and the antenna unit 100 is indicated by a positive value (i.e., when the antenna unit 100 is disposed close to the right-side metal panel 28*a*). Meanwhile, the distance P between the left-side metal panel 28*a* and the antenna unit 100 is indicated by a negative value (i.e., when the antenna unit 100 is disposed close to the left-side metal panel 28*a*). "L" indicates the length of the upper wall 111. The length L of For each of the 24 samples, the average gain (dBi) on a plane (X-Y plane) along the bottom plate 27 was measured at three communication frequencies of 2.4 GHz, 2.442 GHz, and 2.484 GHz. The measurement results at the three communication frequencies and the total average of the measurement results are provided in table 2 for each of the 24 samples.

As the results indicate, with the antenna unit 100 of the embodiment, the gain was mostly greater than −7 dBi. Also, as the measurement results for samples "test 15" through "test 18" indicate, properly setting the dimensions of the antenna unit 100 makes it possible to achieve antenna gain higher than −5 dBi.

Although not referred to in the above experiments, the gain of the chip antenna 130 installed as in the comparative example varies greatly depending on the shape of the FFC 125.

Meanwhile, with the antenna unit 100 of the embodiment, the gain of the chip antenna 130 does not vary greatly depending on whether the FFC 125 is connected. As indicated in table 2, the FFC 125 affects the antenna gain only about 1 dBi. Thus, the antenna unit 100 of the embodiment makes it possible to stably achieve high antenna gain.

Thus, the antenna unit 100 of this embodiment makes it possible to reduce the space necessary to install the chip antenna 130 while achieving high antenna gain.

In the above descriptions, it is assumed that the chip antenna 130 is a Bluetooth (registered trademark) antenna for radio communications. However, an antenna conforming to a radio communication standard other than Bluetooth (registered trademark) may instead be used as the chip antenna 130.

Also, the chip antenna 130 may be replaced with any other type of antenna. For example, an inverted-F antenna may be used instead of the chip antenna 130 of the above embodiment.

Also in the above embodiment, the rear edges of the left-side and right-side walls 112 and 113 and the rear edge of the upper wall 111 of the housing 110 are welded to the rear wall 114. Alternatively, the rear edges of the left-side and right-side walls 112 and 113 and the rear edge of the upper wall 111 may be fixed to the rear wall 114 with a conductive tape such as a copper tape.

In the above embodiment, the upper wall 111 to which the substrate 120 is screwed is in contact with the rear wall 114. Alternatively, a gap may be provided between the upper wall 111 and the rear wall 114 unless the gap functions as an insulator for an alternating current signal with a communication frequency.

In the above embodiment, it is assumed that the housing 110 is formed by folding a single metal plate. Alternatively, each of the walls constituting the housing 110 may be implemented by a single metal plate and the housing 110 may be formed by joining multiple metal plates together by welding or by using a conductive tape.

An aspect of this disclosure provides an antenna unit and an electronic apparatus including the antenna unit that makes it possible to reduce the space needed to install an antenna in the electronic apparatus while achieving high antenna gain.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

The invention claimed is:

1. An antenna unit, comprising:

a housing composed of a conductive material, the housing including a bottom wall, first and second side walls that extend upward from corresponding side edges of the bottom wall, a rear wall that extends upward from a rear edge of the bottom wall along rear edges of the first and second side walls, an upper wall that extends from an upper edge of the first side wall toward the second side wall leaving a gap between an edge of the upper wall and the second side wall, and an opening formed by the bottom wall, first and second side walls and the upper wall to face the rear wall;

a substrate fixed to the upper wall, a part of the substrate projecting from the edge of the upper wall to a position that is closer to the second side wall than is the edge of the upper wall; and an antenna shaped like a cuboid and having a radio-wave emitting aperture in a side surface thereof, the side surface intersecting a long axis of the antenna and the antenna being fixed to the part of the substrate projecting from the edge of the upper wall such that the radio-wave emitting aperture of the antenna faces the opening of the housing.

2. The antenna unit as claimed in claim 1, wherein the housing is formed by folding a single conductive plate.

3. The antenna unit as claimed in claim 1, wherein the housing further includes a flange that extends rearward from an upper edge of the rear wall and is configured to be fixed to an electronic apparatus where the antenna unit is installed.

4. The antenna unit as claimed in claim 3, wherein the flange is formed by bending a part of the rear wall.

5. The antenna unit as claimed in claim 3, wherein the flange includes a through hole and a notch formed therein, the through hole and the notch being used to screw the flange to the electronic apparatus.

6. The antenna unit as claimed in claim 1, wherein the rear edges of the first and second side walls and a rear edge of the upper wall are welded to the rear wall.

7. The antenna unit as claimed in claim 1, wherein the rear edges of the first and second side walls and a rear edge of the upper wall are fixed to the rear wall with a conductive tape.

8. An electronic apparatus, comprising:

an antenna unit configured to transmit and receive radio signals, wherein the antenna unit includes a housing composed of a conductive material and including a bottom wall, first and second side walls that extend upward from corresponding side edges of the bottom wall, a rear wall that extends upward from a rear edge of the bottom wall along rear edges of the first and second side walls, an upper wall that extends from an upper edge of the first side wall toward the second side wall leaving a gap between an edge of the upper wall and the second side wall, and an opening formed by the bottom wall, first and second side walls and the upper wall to face the rear wall;

a substrate fixed to the upper wall, a part of the substrate projecting from the edge of the upper wall to a position that is closer to the second side wall than is the edge of the upper wall; and an antenna shaped like a cuboid and having a radio-wave emitting aperture in a side surface thereof, the side surface intersecting a long axis of the antenna and the antenna being fixed to the part of the substrate projecting from the edge of the upper wall such that the radio-wave emitting aperture of the antenna faces the opening of the housing.

9. The electronic apparatus as claimed in claim 8, wherein only non-conductive components are disposed in the electronic apparatus above the antenna unit and in a radio-wave emitting direction from a front side of the antenna unit.

* * * * *